US007942154B2

(12) United States Patent
Taniguchi et al.

(10) Patent No.: US 7,942,154 B2
(45) Date of Patent: May 17, 2011

(54) CIGARETTE FILTER MATERIAL AND CIGARETTE FILTER

(75) Inventors: Hiroki Taniguchi, Himeji (JP); Takashi Hibi, Himeji (JP)

(73) Assignee: Daicel Chemical Industries, Ltd., Sakai-shi (JP)

( * ) Notice: Subject to any disclaimer, the term of this patent is extended or adjusted under 35 U.S.C. 154(b) by 992 days.

(21) Appl. No.: 11/794,224

(22) PCT Filed: Dec. 21, 2005

(86) PCT No.: PCT/JP2005/023472

§ 371 (c)(1), (2), (4) Date: Jun. 26, 2007

(87) PCT Pub. No.: WO2006/070662

PCT Pub. Date: Jul. 6, 2006

(65) Prior Publication Data

US 2008/0053467 A1 Mar. 6, 2008

(30) Foreign Application Priority Data

Dec. 27, 2004 (JP) ..... 2004-378188

(51) Int. Cl.
*A24B 15/28* (2006.01)

(52) U.S. Cl. ..... 131/332; 131/334

(58) Field of Classification Search ..... None
See application file for complete search history.

(56) References Cited

U.S. PATENT DOCUMENTS

| | | | | |
|---|---|---|---|---|
| 5,246,017 | A * | 9/1993 | Saintsing et al. | 131/335 |
| 5,695,218 | A | 12/1997 | Nicosia | |
| 6,209,547 | B1 | 4/2001 | Koller et al. | |
| 6,289,898 | B1 | 9/2001 | Fournier et al. | |

FOREIGN PATENT DOCUMENTS

| | | | |
|---|---|---|---|
| JP | 53-142600 | A | 12/1978 |
| JP | 57-71388 | A | 5/1982 |
| JP | 59-88078 | A | 5/1984 |
| JP | 59-9151882 | A | 8/1984 |
| JP | 60-54669 | A | 3/1985 |
| JP | 60-168373 | A | 8/1985 |
| JP | 62-111679 | A | 5/1987 |
| JP | 63-63369 | A | 3/1988 |
| JP | 5-46297 | U | 6/1993 |
| JP | 6-90727 | A | 4/1994 |
| JP | 7-31452 | A | 2/1995 |
| JP | 11-100713 | A | 4/1999 |
| JP | 2002-528105 | A | 9/2002 |
| JP | 2002-528106 | A | 9/2002 |
| JP | 2003-505618 | A | 2/2003 |
| JP | 2003-62420 | A | 3/2003 |
| JP | 2006-34127 | A | 2/2006 |
| WO | WO-00/25610 | A1 | 5/2000 |
| WO | WO-00/25611 | A1 | 5/2000 |
| WO | WO-01/08514 | A1 | 2/2001 |

OTHER PUBLICATIONS

English translation of JP63063369A.*

Bioshell Inc., "Chitosan Specifications", Mar. 2, 1983 (added to public archive May 24, 1999), Bates No. 508005725, Brown & Williamson Collection, http://legacy.library.ucsf.edu/tid/nri23f00.*

* cited by examiner

*Primary Examiner* — Richard Crispino
*Assistant Examiner* — Michael J Felton
(74) *Attorney, Agent, or Firm* — Birch, Stewart, Kolasch & Birch, LLP

(57) ABSTRACT

The present invention provides a cigarette filter material useful for selectively and efficiently reducing formaldehyde while maintaining a palatable component such as nicotine or tar. The cigarette filter material is obtained by coating-treating a substrate (such as a cellulose acetate fiber) with a solution (particularly, an aqueous solution) containing a polysaccharide having an amino group (e.g. chitosan) and a polar solvent (e.g., water) [and optionally an acid such as a hydroxy acid (e.g., lactic acid)]. A cigarette filter of such a cigarette filter material can efficiently and selectively reduce formaldehyde. For example, the cigarette filter ensures a retention of formaldehyde of not more than 65% while maintaining retentions of nicotine and tar of not less than 80%, respectively, in main stream smoke.

13 Claims, No Drawings

CIGARETTE FILTER MATERIAL AND CIGARETTE FILTER

TECHNICAL FIELD

The present invention relates to a cigarette filter material useful for selectively and efficiently removing an aldehyde (in particular formaldehyde) while maintaining a palatable component such as nicotine or tar, a process for producing the same, and a cigarette filter (and a cigarette) formed from the cigarette filter material.

BACKGROUND ART

A variety of components has been proposed as an adsorbent for filtrating ingredients in smoke. As such components, in view of adsorbing an acidic component, formaldehyde, or others, components containing a basic component (such as an amine component) has been enough reported. For example, Japanese Patent Application Laid-Open Nos. 88078/1984 (JP-59-88078A) (Document 1), 151882/1984 (JP-59-151882A) (Document 2) and 54669/1985 (JP-60-54669A) (Document 3) disclose an adsorbent for cigarette filter, in which a polyethyleneimine, or an aliphatic amine having a low vapor pressure is impregnated to an active carbon. Japanese Patent Application Laid-Open Nos. 528105/2002 (JP-2002-528105A) (Document 4) and 528106/2002 (JP-2002-528106A)(Document 5) disclose a cigarette filter having 3-aminopropylsilyl covalently bonded to a related atomic group. Moreover, Japanese Patent Application Laid-Open No. 505618/2003 (JP-2003-505618A) (Document 6) discloses a filler containing an ammonium salt, and Japanese Patent Application Laid-Open No. 71388/1982 (JP-57-71388A)(Document 7) discloses addition of an amino acid for improving flavor of cigarette.

However, most of the basic components as described above, in particular, synthetic polymeric amines, often have a smell of a specific amine odor due to decomposition of the amines or remain of low molecular weight components. Moreover, the basic component itself or a volatile substance contained therein vaporizes and shows toxicity to the human body in many cases. Incidentally, the volatilization of the basic component can be inhibited by acidifying a solution thereof in the impregnation step. The basic component, however, has a potential for liberation for some reason, e.g., contact with other basic substances or hydrolysis. Further, although a component such as an amino acid is often crystallized and has a low volatile, enough adsorption effects in smoke cannot be expected because the amino acid has a low adsorption activity in such a crystal state. Thus, it has been considered that an adsorbent containing a conventional basic component has some effects on removal of the acidic substance or the aldehyde, however such an adsorbent has been impractical for the adsorbent for cigarette filter in terms of safety or effects thereof.

On the other hand, among such basic substances, a chitosan derivative such as a chitin or a chitosan does not crystallize or volatilize. Moreover, it is known that the chitosan derivative is harmless to the human body and has an antibacterial activity. For example, Japanese Patent Application Laid-Open No. 100713/1999 (JP-11-100713A) (Document 8) discloses a chitosan-containing cellulose acetate fiber which contains a chitosan and has an antibacterial rate of not lower than 26%. This document mentions that dispersion and inclusion of a chitosan in a spin dope, for example, by a manner such as a method of adding or mixing a chitosan-dispersed liquid to a dope for cellulose acetate, wherein the dispersion contains a chitosan pulverized to a size smaller than a predetermined size (a maximum particle size of not larger than 3 μm), or a method of adding or mixing a chitosan to the solvent directly and preparing the size of the chitosan by a certain dispersion condition.

Moreover, cigarette filters made of such a chitin or chitosan derivative have been also proposed. For example, Japanese Patent Application Laid-Open No. 142600/1978 (JP-53-142600A) (Document 9) discloses a cigarette filter containing a chitin or chitin derivative in a proportion of not less than 3 wt % relative to the cigarette filter. This document mentions that the chitin is poly-N-acetyl-D-glucosamine, and that a method for involving the chitin in the filter may include a method comprising directly blending a powder obtained from the chitin with a cigarette filter material, or a method comprising dissolving the chitin in a polar solvent such as acetic anhydride, dichloroacetic acid, methanesulfonic acid, or dimethylacetamide or dimethylformamide containing a chloride or a bromide of lithium, calcium or magnesium, then extruding the solution in a coagulant such as isopropyl ether to give a fiber or film, and blending the fiber or film with a cigarette filter material. Further, the document describes that, in the case of particularly blending the chitin and chitin derivative with an acetate filter, the chitin and chitin derivative imparts a distinctive light aroma and palatability to a cigarette due to a synergistic effect between an acetyl group in the derivative and an acetyl group in the acetate. To be concrete, the document mentions that the reducing (or removing) rate of tar is 34 to 41% and that of nicotine is 28 to 29% in Examples so that the characteristics are equivalent or more on conventional article.

Japanese Patent Application Laid-Open No. 168373/1985 (JP-60-168373A) (Document 10) discloses a cigarette filter comprising, as a material, a fiber consisting of a chitin or a derivative thereof (e.g., a chitosan obtained by deacetylation of part or all of acetylamino groups in the chitin, and a compound which is obtained by etherifying, esterifying, hydroxyethylifying or O-methylifying OH groups or $CH_2OH$ groups in a chitin). This document mentions that a production process for the fiber preferably includes a process comprising dissolving a chitin or a derivative thereof in a solvent to form a dope, and forming the dope into a fiber by a wet spinning process. The cigarette filter described in this document tends to adsorb tar or nicotine in use compared with a filter containing triacetylcellulose or a rayon as a material, and has an adsorption and adhesion performance one-and-a half times to twice or more as high as a conventional filter.

Japanese Patent Application Laid-Open No. 111679/1987 (JP-62-111679A) (Document 11) discloses a cigarette filter material containing a polysaccharide ion exchanger or a powdery polysaccharide (e.g., a cellulose, an agarose, an amylose, a chitin, and a chitosan) for removing a mutagenic compound in smoke during smoking. This document mentions that the polysaccharide ion exchanger or the powdery polysaccharide can be used as a filter of a cigarette body, or in the form dispersed or inserted in a space of an acetate filter.

Japanese Patent Application Laid-Open No. 31452/1995 (JP-7-31452A) (Document 12) discloses a cigarette filter containing a chitin or a chitosan in a proportion of 5 to 100% by weight. This document mentions that the chitin or chitosan may form, for example, a salt with a carboxylic acid (such as acetic acid, succinic acid, benzoic acid, phthalic acid, tartaric acid, malic acid or citric acid), an amino acid (such as glycine, glutamic acid or phenylalanine), an inorganic acid (such as a phosphoric acid or a boric acid), or a partial ester of an organic or inorganic polycarboxylic acid. Moreover, this document mentions that the chitin or chitosan may be used by impregnating a substrate comprising a powder or a fiber of, for example, silica, alumina, aluminosilicate, zirconia, activated carbon, or a cellulose (such as rayon, cotton or wood pulp), a starch, a protein (such as a gelatin or a casein), or a synthetic resin (such as cellulose acetate, a polyethylene, a polyester or a nylon) with the chitin or chitosan solution, and then drying the resulting matter. According to the filter described in this document, a harmful component such as nicotine, tar or an aldehyde in smoke can be effectively adsorbed and collected. Incidentally, as a concrete method using the chitin or chitosan solution, Example 5 has mentioned that a filter was formed by immersing 80 mg of an absorbent cotton in 1% aqueous solution of a chitin or chitosan (having a degree of deacetylation of 50%), vacuum drying the immersed cotton to give an absorbent cotton (100 mg) containing 20 mg of the chitin or chitosan, and filling the cotton in a paper pipe to form a filter chip, and the filter had a collecting rate of nicotine of 48%, that of tar of 45%, and that of acrolein of 72%.

Incidentally, it is conventionally considered that nicotine or tar is a main harmful component in smoke, and there is growing interest in delivery of nicotine or tar. Many countries obligate indication of nicotine and tar. However, it appears that nicotine itself is a taste component of a cigarette and directly takes part in contentment of smoking. Moreover, regarding tar, removal of a tar component in smoke at a relatively high level is not preferred because aroma and palatability are deteriorated. That is, indiscriminate reduction of low-volatile smoke components containing tar or nicotine brings about insufficient taste and feeling of unsatisfaction. On the other hand, an aldehyde, in particular formaldehyde, not only has a pungent odor but also effects on health adversely, and has attracted attention as one of allergens recently. Accordingly, it is consequently preferred to remove the aldehyde as much as possible.

It is therefore required to selectively remove an aldehyde component (particularly formaldehyde) in smoke while maintaining the amount of tar or nicotine in the smoke at a relatively high level.

However, although the cigarette filter containing the above-mentioned chitin or chitosan derivative have relatively safe on the human body, the filter highly removes not only the aldehyde such as formaldehyde but also a component such as nicotine or tar. As a result, the cigarette deteriorates taste and palatability (or aroma and palatability).

More specifically, in the case of directly using a particle or a fiber of the chitin, the chitosan derivative, or the like for a cigarette filter, the cigarette filter has non-selective adsorbality to formaldehyde, and highly adsorbs not only formaldehyde but also tar or nicotine as is the case with an activated carbon or others. As a result, the amount of tar or nicotine falls away, and the taste and palatability is not entirely satisfactory for smokers. Accordingly, smokers often unintentionally inhale smoke deeply or frequently during smoking.

Further, since the chitosan or the like is hard and fragile in its own, there is a possibility that, in a filter consisting of a fiber of the chitosan, the chitosan fiber dropped out from the filter is aspirated into the human body and causes injury to respiratory organs. Moreover, as described in the above-mentioned Document 12, even in the case of adding a chitosan particle to cellulose acetate filter which is used habitually as a cigarette filter, there is the possibility that the particle damages respiratory organs due to dropout.

Therefore, a cigarette filter enabling a small adsorption of tar or nicotine while maintaining selective adsorbability to formaldehyde has been required.

Document 1: Japanese Patent Application Laid-Open No. 88078/1984 (JP-59-88078A) (claims)

Document 2: Japanese Patent Application Laid-Open No. 151882/1984 (JP-59-151882A)(claims)

Document 3: Japanese Patent Application Laid-Open No. 54669/1985 (JP-60-54669A) (claims)

Document 4: Japanese Patent Application Laid-Open No. 528105/2002 (JP-2002-528105A) (claims)

Document 5: Japanese Patent Application Laid-Open No. 528106/2002 (JP-2002-528106A) (claims)

Document 6: Japanese Patent Application Laid-Open No. 505618/2003 (JP-2003-505618A) (claims)

Document 7: Japanese Patent Application Laid-Open No. 71388/1982 (JP-57-71388A) (claims)

Document 8: Japanese Patent Application Laid-Open No. 100713/1999 (JP-11-100713A) (claims, Paragraph number [0012])

Document 9: Japanese Patent Application Laid-Open No. 142600/1978 (JP-53-142600A) (claims; page 2, the upper left column, line 1 to the upper right column, line 2; and Examples)

Document 10: Japanese Patent Application Laid-Open No. 168373/1985 (JP-60-168373A) (claims; and page 1, the right column line 16 to page 2, the upper right column line 15)

Document 11: Japanese Patent Application Laid-Open No. 111679/1987 (JP-62-111679A) (claims; and page 2, the upper left column, lines 1 to 17)

Document 12: Japanese Patent Application Laid-Open No. 31452/1995 (JP-7-31452A) (claims; Paragraph numbers [0004], [0006]; and Examples)

DISCLOSURE OF THE INVENTION

Problems to be Solved by the Invention

It is therefore an object of the present invention to provide a cigarette filter material capable of reducing (or removing) efficiently an aldehyde (in particular, formaldehyde) while maintaining a taste and palatability (or aroma and palatability) component such as tar or nicotine at a high level.

Another object of the present invention is to provide an odorless cigarette filter material which has safety in oral intake and which is useful for selectively reducing an aldehyde (in particular, formaldehyde).

A further object of the present invention is to provide a process for conveniently and efficiently producing a cigarette filter material capable of selectively reducing an aldehyde (in particular, formaldehyde).

It is a still another object of the present invention to provide a cigarette filter capable of selectively reducing an aldehyde (in particular, formaldehyde) without deterioration of taste and palatability, and a cigarette comprising the cigarette filter.

Means to Solve the Problems

The inventors of the present invention made intensive studies to achieve the above objects. The inventors finally found that, in a cigarette filter material in which a substrate (e.g., a substrate having a filter rod structure) is coated with a polysaccharide having an amino group (e.g., a chitosan) and a polar solvent (for example, a hydroxyl group-containing solvent such as water or an alcohol), the polar solvent efficiently restrains or inhibits a spontaneous formation of a hydrogen bond of the polysaccharide on drying; and that such a restraint or inhibition can efficiently express adsorption (or absorption) performance of the amino group to an aldehyde. As a result, the inventors further found that the cigarette filter material can selectively adsorb an aldehyde (in particular, formaldehyde) compared with palatable components such as tar and nicotine probably because the filter exerts chemical adsorption performance due to the amino group in the polysaccharide. The present invention was accomplished based on the above findings.

That is, the cigarette filter material of the present invention comprises a substrate coated (or coating-treated) with a coating composition containing a polysaccharide having an amino group and a polar solvent, and the polar solvent resides in the cigarette filter material. The material may have a filter rod structure (for example, may be a filter having a filter rod structure). Incidentally, the filter rod structure means a structure (a filter structure) formed by arranging a given amount of mono-filaments (for example, about 3000 to 100000 mono-filaments) in the flow direction of a mainstream smoke. The polysaccharide having an amino group may be a chitosan, and the cigarette filter material may contain about 2 to 20 parts by weight of the polysaccharide having an amino group relative to 100 parts by weight of the substrate. The polar solvent may be a solvent which can reduce an influence on a hydrogen bond in the polysaccharide having an amino group, and may be a hydroxyl group-containing solvent (e.g., at least one hydroxyl group-containing solvent selected from the group consisting of water and an alcohol). The proportion of such a hydroxyl group-containing solvent may be about not less than 8 mol, in terms of hydroxyl group, relative to 1 mol of a glycose unit of the polysaccharide having an amino group. The coating composition for coating the substrate (or the cigarette filter material) may further comprise an acid (for example, at least one acid selected from the group consisting of a phosphoric acid and a hydroxy acid). The proportion of such an acid may be about 0.1 to 3 mol, in terms of acid group, relative to 1 mol of a glycose unit of the polysaccharide having an amino group.

In the typical cigarette filter material, for example, the substrate has a filter rod structure, and the material comprises (i) a chitosan, having a degree of deacetylation of not less than 70%, in a proportion of 3 to 15 parts by weight relative to 100 parts by weight of the substrate, (ii) a hydroxyl group-containing solvent in a proportion of not less than 9 mol, in terms of hydroxyl group, relative to 1 mol of a glycose unit of the chitosan, and (iii) a monohydroxy$C_{2-6}$alkanemonocarboxylic acid in a proportion of 0.5 to 2 mol, in terms of carboxyl group, relative to 1 mol of the glycose unit of the chitosan.

The cigarette filter material of the present invention may be obtained by coating (or coating-treating) a substrate with a solution at least containing a polysaccharide having an amino group and a polar solvent (a solution of a polysaccharide having an amino group). In the representative process, the cigarette filter material may be produced by coating the substrate with a solution containing a polysaccharide having an amino group, a polar solvent and an acid. In such a production process, the polysaccharide having an amino group preferably has a reduced molecular weight. For example, as the polysaccharide, may be used an amino group-containing polysaccharide (e.g., a chitosan) which has a solution viscosity of about 1 to 10 mPa·s at 20° C. in an acetic acid aqueous solution having an acetic acid concentration of 1% by weight.

The present invention includes a cigarette filter made of the cigarette filter material. Since such a cigarette filter can efficiently and selectively reduce (or remove) formaldehyde, the present invention also includes a method for reducing an amount of an aldehyde (in particular formaldehyde) in main stream smoke, which comprises forming the cigarette filter from the filter tow. In such a method, taste and palatability (or aroma and palatability) components (such as nicotine and tar) may be maintained at a high level. For example, the retention of formaldehyde may be not more than 70% [for example, about 5 to 65%, preferably about not more than 65% (e.g., about 10 to 60%), and more preferably not more than 50% (e.g., about 15 to 45%)] while maintaining each retention of nicotine and tar of not less than 80% (e.g., about 85 to 98%).

Moreover, the present invention includes a cigarette comprising said cigarette filter.

Incidentally, throughout this specification, the term "chitosan" means a deacetylated compound obtainable by heating chitin [(β-1,4-poly-N-acetyl-D-glucosamine, $(C_8H_{13}NO_5)_n$] with a concentrated alkali solution, or other means, and the chitosan at least has a polymer structure, β-1,4-poly-D-glucosamine.

Moreover, throughout this specification, the "solution of a polysaccharide having an amino group" may include a solution containing at least a polysaccharide having an amino group dissolved in a system containing a polar solvent (and if necessary a hydroxy acid), or may contain any nonsoluble component other than a polysaccharide having an amino group.

Effects of the Invention

According to the present invention, the substrate (e.g., a substrate having a filter rod structure made from a cellulose ester fiber) is treated with a polysaccharide having an amino group and a polar solvent (and if necessary an acid such as a hydroxy acid) in combination in the form of a solution. And the effect is that an aldehyde (in particular, formaldehyde) can be efficiently reduced (or removed) while maintaining a taste and palatability (or aroma and palatability) component such as tar or nicotine at a high level. Moreover, the cigarette filter material (and the cigarette filter) of the present invention is odorless and safe even in the case of oral intake because of using a polysaccharide having an amino group and a polar solvent such as water (and an acid such as lactic acid), and is useful for selective reduction (or removal) of an aldehyde (in particular, formaldehyde). Such a cigarette filter material may be conveniently and efficiently produced, for example, by dipping (or immersing) a substrate in a solution containing a polysaccharide having an amino group and a polar solvent (and an acid such as a hydroxy acid). The cigarette filter of the present invention can therefore selectively reduce (or remove) an aldehyde (in particular, formaldehyde) without deterioration of taste and palatability.

DETAILED DESCRIPTION OF THE INVENTION

[Cigarette Filter Material]

In the cigarette filter material of the present invention (hereinafter, may be simply referred to as "filter material" or "material"), a substrate contained in the filter material is coated or coating-treated (hereinafter, may be simply referred to as "treat(ed)") with a coating composition containing a polysaccharide having an amino group and a polar solvent, and the material at least contains the polysaccharide having an amino group and the polar solvent (and if necessary the after-mentioned humectant or acid). That is, the cigarette filter material of the present invention is coated with the polysaccharide having an amino group, and contains part or all of the polar solvent. Such a cigarette filter material (more specifically, a cigarette filter material which comprises a substrate having a coat formed thereon) may be usually obtained by treating a substrate with a solution containing a polysaccharide having an amino group and a polar solvent (a solution of a polysaccharide having an amino group), as described later.

(Substrate)

The substrate may be treated with the composition containing the polysaccharide having an amino group and the polar solvent (or the solution of the polysaccharide having an amino group), and may comprise, depending on the shape (or structure) of the substrate, for example, a fiber (or fibrous material) such as a natural or synthetic fiber {for example, a cellulose ester fiber (e.g., a cellulose acetate fiber), a cellulose fiber [for example, a wood fiber (e.g., a wood pulp fiber made from a softwood, hardwood, or others), a species fiber (e.g., a cotton fiber such as a linter), a bast fiber, and a leaf fiber or a leafstalk (e.g., Manila hemp, and New Zealand flax)], a regenerated fiber (e.g., a viscose rayon, a cupra (cuprammonium rayon), and an artificial silk treated with nitric acid), a polyester fiber, a polyurethane fiber, a polyamide fiber, and a polyolefin fiber (e.g., a polyethylene fiber, and a polypropylene fiber)}, a particulate material [for example, an inorganic particle (such as an activated carbon, a diatomaceous earth, a silica gel, an alumina, a titanium oxide, a zirconia or a zeolite), a chip of wood, and a particle comprising other natural or synthetic polymer], and a protein (e.g., a gelatin, and a casein). These components of the substrate may be used singly or in combination.

Among them, the preferred component of the substrate may include a fiber (a fibrous material), for example, a cellulose ester fiber. In the cellulose ester fiber, examples of the cellulose ester may include an organic acid ester such as cellulose acetate, cellulose propionate or cellulose butyrate; an inorganic acid ester such as cellulose nitrate, cellulose sulfate or cellulose phosphate; a mixed acid ester such as cellulose acetate propionate, cellulose acetate butyrate, cellulose acetate phthalate or cellulose nitrate acetate; and a cellulose ester derivative such as a polycaprolactone-grafted cellulose acetate. These cellulose esters may be used singly or in combination. Among them, the preferred cellulose ester may include an organic acid ester (for example, an ester of a cellulose with an organic acid having a carbon number of about 2 to 4), for example, cellulose acetate, cellulose propionate, cellulose butyrate, cellulose acetate propionate, cellulose acetate butyrate, and others. In particular, cellulose acetate (particularly cellulose diacetate) is preferred.

The degree of polymerization of the cellulose ester may be usually about 10 to 1000 (for example, about 50 to 1000), preferably about 50 to 900 (for example, about 100 to 800), and more preferably about 200 to 800.

Moreover, the degree of substitution of the cellulose ester (particularly cellulose acetate) may be, for example, selected from the range of about 1 to 3 (for example, about 1 to 2.9), preferably may be about 1.5 to 2.7, and more preferably about 1.7 to 2.6.

As for the fiber (for example, the cellulose ester fiber) constituting the substrate, the fiber length may be selected from the range of about 0.1 mm to 5 cm, for example, may be about 0.5 to 30 mm (for example, about 1 to 25 mm), preferably about 2 to 20 mm, and more preferably about 3 to 15 mm (for example, about 5 to 10 mm). Moreover, the fiber diameter may be, for example, about 0.01 to 100 μm, preferably about 0.5 to 80 μm, and more preferably about 1 to 50 μm.

Incidentally, the filament in the filter tow (for example, the cellulose ester filament) may have a crimping structure. And, the filament can have a non-crimping structure.

Further, in the particle material (or the particulate material), the average particle size may be, for example, about 0.1 to 600 μm, preferably about 10 to 500 μm, more preferably 20 to 250 μm, and usually about 200 to 500 μm.

The shape (or the structure) of the substrate may be suitably selected depending on the constitutive component form (e.g., the fiber, and the particle), and may be a shape of the constitutive component itself, such as a fibrous form or a particle form (or a particulate) or may be any form such as a capillaceous form, a woven fabric form, a nonwoven fabric form, a filter rod structure (or a filter rod-like form, for example, a filter rod structure having a crimped structure), a paper form (or a paper or a paper structure), a sheet form and granules. Incidentally, the substrate having the paper structure may be obtained by making a staple from the fiber and forming the staple into a sheet through a dry or wet nonwoven fabric process, or by mixing the staple with a beat pulp to give a slurry and forming the slurry into a paper.

Moreover, the substrate may be a pre-formed filter (for example, a filter rod formed from a cellulose ester (such as cellulose acetate) having a crimped structure). Such a pre-formed filter (or filter-like) substrate can be directly used as a cigarette filter after coating treatment (and drying).

The preferred substrate may be in the form of a filter rod formed from a fiber [or a filter (a filter substrate) having a rod formed from a fiber]. A deal of particle matter such as nicotine and tar exist in smoke or aerosol, especially in mainstream smoke. In the case where the substrate comprises a fiber having a fibril, such a particle matter tends to collide with the fibril part. In the substrate having a fibril structure, therefore, the transmittance of nicotine or tar is decreased, and there is the possibility that the substrate is inappropriate for the object of the present invention. On the contrary, the later-mentioned filter rod (or filter having a filter rod structure) having a small amount of the fibril comprises a mono-filament in a broad sense (a multifilament having a substantially infinite continuous length) defined by the polymer engineering. Accordingly, such a filter rod (or filter) ensures to give an excellent delivery (or permeability) to nicotine or tar without collision with any particle matter.

From such a viewpoint, therefore, the substrate comprises the rod (or the filter rod) formed from a mono-filament rather than the rod that has a sheet formed from a natural fiber having a fibril, e.g., a natural fiber such as a cotton lint or an absorbent cotton and a beat pulp (e.g., see Example 3 described in the above-mentioned Japanese Patent Application Laid-Open No. 31452/0995 (JP-7-31452A)).

(Substrate Having Rod Structure or Filter Substrate Having Filter Rod Structure)

As mentioned above, in the present invention, the most preferred substrate is a substrate having a filter rod (in particular, a filter substrate having a filter rod structure (or a filter rod substrate)). The filter rod (the filter having a rod structure) may comprise a mono-filament, that is a conventional filter material (fiber), and may be made by spinning (dry, melt or wet spinning). Examples of the fiber constituting the filter rod substrate (that is, a compact of a mono-filament) may include, for example, the cellulose fiber, the regenerated fiber (e.g., the viscose rayon, and the cupra (cuprammonium rayon)), the synthetic fiber such as the cellulose derivative fiber (e.g., the cellulose ester fiber), the polyester fiber, the polyurethane fiber, the polyamide fiber, the polyolefin fiber (e.g., the polyethylene fiber, and the polypropylene fiber), and the others. These fibers may be used singly or in combination.

Examples of the preferred fiber may include the cellulose fiber, the cellulose ester fiber, and the like. In particular, the fiber comprising at least the cellulose ester fiber is preferred. As the cellulose ester fiber, there may be mentioned a fiber similar to the above-mentioned one, for example, a fiber of an organic acid ester such as cellulose acetate fiber, cellulose propionate fiber or cellulose butyrate fiber (for example, a fiber of an organic acid ester having a carbon number of about 2 to 4); a mixed acid ester fiber such as a cellulose acetate propionate fiber or a cellulose acetate butyrate fiber; and a cellulose ester derivative such as a polycaprolactone-grafted cellulose ester fiber. The preferred cellulose ester fiber may include, for example, a cellulose acetate fiber, a cellulose propionate fiber, a cellulose butyrate fiber, a cellulose acetate propionate fiber, a cellulose acetate butyrate fiber, and the like. In particular, the cellulose acetate fiber is preferred. These cellulose ester fibers may be also used singly or in combination.

In the filter rod, the degree of polymerization of the cellulose ester may be, for example, about 50 to 900, and preferably about 200 to 800. Moreover, the degree of substitution of the cellulose ester may be selected from the range of, for example, about 1.5 to 3.0.

The shape at cross section in the filament is not particularly limited to a specific one, and for example, may be any form such as a circular form, an elliptical form, an irregular form (for example, Y-shaped form, X-shaped form, I-shaped form, R-shaped form, and H-shaped form) or a shape at cross section of hollow fiber. The shape at cross section is preferably a polygonal irregular form such as Y-shaped form, X-shaped form, I-shaped form, R-shaped form or H-shaped form. The filament diameter and the filament length may be selected depending on the species of the fiber. For example, the filament diameter may be about 0.01 to 100 μm, and preferably 0.1 to 50 μn, and the filament length may be selected from the range of about 50 μm to 5 cm, and preferably about 100 μm to 3 cm in many cases. In particular, in the case where the substrate is the filter rod, the filament length preferably corresponds to the length of the filter rod or a part of the filter rod (e.g., about 3 to 30 mm, for example, about 10 mm, and about 14 mm).

The fineness of the fiber (e.g., the cellulose ester fiber) may be selected from the range of, for example, about 1 to 16 denier, and preferably 1 to 10 denier. The fiber such as the cellulose ester fiber may have either of a non-crimped structure or a crimped structure. The mono-filament that has a crimped structure is more preferred.

The filter rod substrate is in the form of a rod (a fiber bundle) formed by uniting (sheaving) filaments, for example, 3,000 to 1,000,000 mono-filaments (for example, 3,000 to 100,000 mono-filaments), preferably 5,000 to 100,000 mono-filaments (particularly comprising cellulose ester filaments).

In the case of the filter rod substrate, the substrate may be formed by mixing and uniting a filament treated with an amino group-containing polysaccharide (for example, a chitosan) and an untreated (or raw) filament. The use of a cellulose ester (preferably cellulose acetate) as a material of such an untreated filament is advantageous to taste and palatability, and ensures to adjust the reducing rate of a formaldehyde and the residual rate of tar or nicotine.

(Polysaccharide Having Amino Group)

The polysaccharide having an amino group (or amino group-containing polysaccharide) used in the present invention is not particularly limited to a specific one as far as the polysaccharide is a glucan derivative and has an amino group as a substituent. Representative examples of such a polysaccharide may include a chitosan.

The chitosan may be derived from a chitin in which at least a part of the acetyl group is deacetylated, as mentioned above. The degree of deacetylation of the chitosan may be, for example, not lower than 20% (for example, about 30 to 100%), preferably not lower than 40% (for example, about 50 to 99%), and more preferably not lower than 60% (for example, about 65 to 98%).

The chitosan used in the present invention usually has a relatively high degree of deacetylation (namely, has many amino groups), in order to enhance a selective reducing (or removing) rate against an aldehyde (particularly, formaldehyde), in many cases. That is, the chitosan having a high degree of deacetylation has more amino groups compared with the chitin or the like, and is excellent in a selective reducing effect on an aldehyde (in particular, formaldehyde).

The degree of deacetylation of the chitosan may be therefore, for example, not less than 60% (for example, about 65 to 100%), preferably not less than 70% (for example, about 75 to 99%), and more preferably not less than 80% (for example, about 85 to 98%). Incidentally, in the chitosan, the "degree of deacetylation" is represented by the following formula, wherein the acetyl group of the chitosan is A1 mol and the deacetyl group (i.e., amino group) of the chitosan is A2 mol. Such an acetylation degree may be, for example, analyzed by $^{1}$H-NMR, $^{13}$C-NMR, or other means.

$$A2/(A1+A2)\times 100(\%)$$

Moreover, the base dissociation constant "$pK_b$" of the chitosan at 25° C. may be, for example, not less than 5.5 (for example, about 6 to 12), preferably not less than 6 (for example, about 6.3 to 10), and more preferably not less than 6.5 (for example, about 6.8 to 9). In order to ensure higher reducing rate to the aldehyde (in particular, formaldehyde), the base dissociation constant may be usually not less than 7 (for example, about 7.3 to 11), preferably not less than 7.5 (for example, about 7.8 to 10), and more preferably not less than 8 (for example, 8.5 to 9.5).

Incidentally, the chitosan may be a chitosan derivative produced by derivatization. Such a chitosan derivative may include, for example, a chitosan salt (for example, a carboxylate such as a pyrrolidone carboxylate, a lactate or an alginate), a hydroxylated chitosan [for example, a chitosan protected (or substituted) by a hydroxyalkyl group (e.g., hydroxyethyl group, and hydroxypropyl group), such as hydroxypropylchitosan, and a glycerylated chitosan], and a cationated chitosan. Moreover, the chitosan derivative may include a chitosan in which the OH group or $CH_2OH$ group constituting the chitosan skeleton is protected (or substituted) by a protecting group (or a substituent), for example, an alkyl group (e.g., an alkyl group such as methyl group), an ester group (or acyl group, for example, acetyl group).

Among these chitosan derivatives, the chitosan salt, the hydroxylated chitosan, the cationated chitosan, or the like is often soluble in a polar solvent [for example, water, and an aqueous solvent (e.g., an alcohol)], and the after-mentioned chitosan solution may be efficiently prepared from such a chitosan derivative.

The degree of polymerization of the polysaccharide having an amino group (in particular, the chitosan) may be selected from the range of about 10 to 5000 (for example, about 50 to 4000), and for example, may be about 100 to 3000, preferably about 200 to 2000 and more preferably about 300 to 1500 (for example, about 400 to 1000).

Incidentally, the common amino group-containing polysaccharide such as the chitosan usually has a high degree of polymerization as mentioned above, and has a relatively large solution viscosity even in the case of having a low concentration (for example, a concentration of about 1% by weight). Therefore, it is sometimes difficult to prepare a solution containing the polysaccharide at a high concentration. In the case of treating the substrate with the polysaccharide having a high degree of polymerization, there is the possibility that the impregnating amount (coating amount) of the polysaccharide required for the substrate cannot be enough obtained.

Therefore, in the present invention, the polysaccharide having a small solution viscosity in an aqueous solution may be used. The polysaccharide may have a reduced molecular weight, and such a polysaccharide (e.g., a chitosan) has a solution viscosity at 20° C. of, for example, not higher than 30 mPa·s (for example, about 0.1 to 20 mPa·s), preferably about 0.5 to 15 mPa·s, and more preferably about 1 to 10 mPa·s (for example, about 3 to 7 mPa·s) in an acetic acid aqueous solution containing acetic acid at a concentration of 1% by weight as a solvent. Moreover, the number-average degree of polymerization of such a polysaccharide may be about 3 to 100, preferably about 4 to 50, and more preferably about 5 to 30.

Such a polysaccharide may be obtained by reducing a molecular weight of general polysaccharide in accordance with a method, for example, described in Japanese Patent Application Laid-Open No. 220202/1991 (JP-3-220202A). Moreover, the polysaccharide may be obtained from a polysaccharide solution containing a phosphoric acid or a hydroxy acid under the after-mentioned action.

In the cigarette filter material of the present invention, the content (or impregnating amount) of the polysaccharide may be, not higher than 30 parts by weight (e.g., about 1 to 25 parts by weight), preferably not higher than 20 parts by weight (e.g., about 2 to 20 parts by weight), more preferably not higher than 15 parts by weight (e.g., about 3 to 15 parts by weight), and in particular not higher than 10 parts by weight (e.g., about 5 to 10 parts by weight), relative to 100 parts by weight of the substrate. Too high content of the polysaccharide sometimes enhances the adsorption of tar or nicotine.

(Polar Solvent)

The present invention is characterized by treating the substrate with the above-mentioned amino group-containing polysaccharide and a polar solvent in combination. Probably because the amino groups form a hydrogen bond in the polysaccharide, the polysaccharide is weak in basic or nucleopetal. Therefore, even in the case where such a polysaccharide in the form of a particulate is contained in the substrate, the polysaccharide cannot selectively reduce (adsorptively reduce) a component such as an aldehyde (particularly formaldehyde) efficiently. Accordingly, in the present invention, a polar solvent is added to the polysaccharide. In the result of this, formation of a hydrogen bond between the amino groups of the polysaccharide is decreasing so that there is no or few hydrogen bonds.

Such a polar solvent may be a solvent which can inhibit or reduce an influence on a hydrogen bond in the polysaccharide, and may be usually a hydroxyl group-containing solvent. Water is one of the typical polar solvents. Such a polar solvent can reside in the cigarette filter, and such a polar solvent can efficiently plasticize chitosan. Accordingly, the reducing rate of an aldehyde (particularly, formaldehyde) can be improved. Incidentally, although the polar solvent is a solvent component, in the case of a humectant having a hydroxyl group, the humectant may also behave as a polar solvent.

Examples of the polar solvent may include water, an alcohol [for example, an alkanol (e.g., a $C_{1-4}$alkanol such as methanol, ethanol, 1-propanol, isopropanol, n-butanol, 2-butanol or isobutanol), a cycloalkanol (e.g., a $C_{4-10}$cycloalkanol such as cyclohexanol), an alkanediol (e.g., a $C_{2-4}$alkanediol such as ethylene glycol or propylene glycol), an alkanetriol (e.g., glycerin), and a low molecular weight polyalkylene glycol (e.g., a di- to tetra$C_{2-4}$alkylene glycol such as diethylene glycol or triethylene glycol)], a ketone (e.g., a dialkylketone such as acetone, methylethylketone or methylisobutylketone), and an ether [for example, a cellosolve (e.g., methyl cellosolve, ethyl cellosolve, and butyl cellosolve), a carbitol (e.g., carbitol), a dialkylene glycol alkyl ether (e.g., diethylene glycol dimethyl ether, and diethylene glycol diethyl ether), a glycol ether ester (e.g., ethylene glycol monomethyl ether acetate, propylene glycol monomethyl ether acetate, cellosolve acetate, and butoxycarbitol acetate), a cyclic ether (e.g., dioxane, and tetrahydrofuran), and a dialkyl ether (e.g., diethyl ether)]. The polar solvents may be used singly or in combination.

The preferred polar solvent (in particular, a water-soluble polar solvent) may contain a hydroxyl group, such as water, the alcohol [e.g., the alkanol, and the alkanetriol (e.g., glycerin)] or the cellosolve, from the viewpoint of reducing the effect of the hydrogen bond between the amino groups. The polar solvent especially preferably comprises at least water.

In particular, in the case of using water and other polar solvent (particularly a water-soluble polar solvent) in combination, the boiling point of other polar solvent may be a relatively high temperature, for example, not lower than 100° C. (for example, about 120 to 500° C.), preferably not lower than 150° C. (for example, about 180 to 400° C.), and more preferably not lower than 200° C. (for example, about 250 to 350° C.). The polar solvent having such a high boiling point may include, for example, the alkanediol (e.g., ethylene glycol, and propylene glycol), and the alkanetriol (e.g., glycerin), among the above-mentioned polar solvents.

Other polar solvents may be used singly or in combination. In the case of using two or more different polar solvents as other solvent, the boiling point of at least one polar solvent may be within the above-mentioned range (not lower than 100° C.). Such other polar solvent having a high boiling point [further having a high vapor pressure (that is, being non-volatile)] is difficult to vaporize and acts as a humectant in the end, then can inhibit a moment-to-moment change of selective adsorbability on a formaldehyde. Thus, other polar solvent is advantageously used to form a coat (or a coating) excellent in selective adsorbability on formaldehyde.

Incidentally, in the case of using water and other polar solvent [for example, a polar solvent having a high boiling point, such as the alkanediol or the alkanetriol (e.g., glycerin)] in combination, the proportion of water relative to other polar solvent [the former/the latter (weight ratio)] may be, for example, about 99/1 to 1/99, preferably about 95/5 to 5/95, and more preferably about 90/10 to 10/90 (e.g., about 85/15 to 15/85).

In the cigarette filter material of the present invention, the content (or the residual amount) of the polar solvent (particularly, at least water) may be selected depending on the species of the polar solvent, and for example, may be about 0.01 to 100 parts by weight (e.g., about 0.05 to 90 parts by weight), preferably about 0.1 to 80 parts by weight (e.g., about 0.5 to 70 parts by weight), more preferably 1 to 60 parts by weight (e.g., about 3 to 55 parts by weight), and particularly about 5 to 50 parts by weight (e.g., about 8 to 40 parts by weight), relative to 100 parts by weight of the substrate.

Incidentally, in a fiber (such as a fiber comprised of cellulose acetate filaments) having a relatively large surface area, since a hydrogen bond due to non-substituted hydroxyl group (or residue) of glucose is expected, the fiber can hold adsorbed water by going through a usual production process. However, such an absorbed water content is few milligrams (for example, about 1 to 3 mg) per 100 mg of the substrate at most. In particular, in the case of carrying out vacuum drying or others, the fiber becomes an absolute dry state (the absorbed water content is almost zero).

Moreover, the content (or the residual amount) of the polar solvent (particularly at least water) in the substrate may be for example, depending on the species of the polar solvent (also, the alleviating ability to form a hydrogen bond), not lower than 2 mol (e.g., about 2.5 to 1000 mol), preferably not lower than 3 mol (e.g., about 4 to 800 mol), and more preferably not lower than 5 mol (e.g., about 5.5 to 500 mol), relative to 1 mol of the glycose unit (in the chitosan, the glucose unit).

In particular, in the case where the polar solvent is a hydroxyl group-containing solvent (e.g., water, and an alcohol), the content of said polar solvent may be, in terms of hydroxyl group of the polar solvent (or in the total amount of the hydroxyl group in the whole polar solvent), not lower than 5 mol (e.g., about 7 to 800 mol), for example, not lower than 8 mol (e.g., about 8.5 to 500 mol), preferably not lower than 9 mol (e.g., about 9.3 to 300 mol), and more preferably not lower than 9.5 mol (e.g., about 9.8 to 200 mol), relative to 1 mol of the glycose (or monosaccharide) unit of the polysaccharide having an amino group.

Incidentally, in the case of using, as the polar solvent, water and other polar solvent [for example, a polar solvent having a relatively high boiling point, such as an alkanediol or an alkanetriol (e.g., glycerin)] in combination, the content of the polar solvent (the hydroxyl group-containing solvent) may be, in terms of hydroxyl group of the polar solvent (or in the total amount of the hydroxyl group in the whole polar solvent), for example, about 5 to 100 mol (e.g., about 5.5 to 80 mol), preferably about 6 to 60 mol (e.g., about 7 to 50 mol), more preferably about 8 to 40 mol (e.g., about 8.5 to 30 mol), relative to 1 mol of the glycose (or monosaccharide) unit of the polysaccharide having an amino group.

(Humectant)

The cigarette filter material of the present invention may further comprise a humectant. That is, at least the polar solvent may be used in the present invention as described above, however, such a polar solvent is sometimes easy to vaporize depending on the variety, whereby there is a possibility that the reducing performance on formaldehyde temporally may reduce during storing a filter plug and a cigarette. Accordingly, the polar solvent may be used in combination with a humectant (or a holding component to the polar solvent) having solubility in the polar solvent (e.g., water), being nonvolatile (or having a high boiling point), and being capable of inhibiting volatilization of the polar solvent. The combination use with such a humectant ensures to give a coat (or a coating) having a small change on standing and being excellent in selective adsorbability on formaldehyde.

The most preferred humectant is a nonvolatile humectant having a hydroxyl group and solubility in water. Moreover, in the case of using an alcohol or the like as the polar solvent, it is not very necessary that the humectant is water soluble. For example, in the case of using a chitosan derivative or the like as the polysaccharide, the derivative is alcohol-soluble depending on the species of the derivative. In such a case, it is not necessary to use a water-soluble humectant. That is, the preferred property as the humectant is to be soluble in a polar solvent (not limited to water) and to inhibit volatilization of the solvent. Moreover, the humectant further preferably has a hydroxyl group and is capable of inhibiting to form a hydrogen bond due to an amino group, similar to the polar solvent. The humectant may be a low or high molecular compound as far as the component is nonvolatile (or has a low vapor pressure and a high boiling point) and has solubility in a polar solvent. A water-soluble polysaccharide is one of the high molecular compounds as the humectant.

Incidentally, the humectant may have a high affinity for the polar solvent, and act as a solvent (a polar solvent). In some cases, the humectant may have a polar group such as hydroxyl group.

Examples of such a humectant may include a polyglycerin (e.g., diglycerin, and triglycerin), a hydroxyl group- or ether bond (ether group)-containing synthetic polymer [for example, a polyvinyl alcohol, and a polyalkylene glycol (e.g., a polyethylene oxide, a polypropylene oxide, and a polyethylene oxide-polypropylene oxide)], a natural polymer (e.g., a gelatin, a dextrin, and a starch), a cellulose derivative [for example, a cellulose ether, e.g., a hydroxyalkyl cellulose (such as hydroxyethyl cellulose or hydroxypropyl cellulose), a hydroxyl group-containing cellulose derivative (e.g., an alkyl-hydroxyalkyl cellulose such as ethylhydroxyethyl cellulose), a carboxyalkyl cellulose (such as carboxymethyl cellulose), and an alkyl cellulose (such as ethyl cellulose)]. These humectants may be used singly or in combination. In combination with the polar solvent, such a humectant plasticizes a chitosan more efficiently. Moreover, the humectant forms a matrix with a chitosan and dissolves a smoke component, then transports the smoke component to the chitosan. In such results, the humectant can further improve the adsorptive activity of chitosan on the aldehyde.

In the case of using the humectant, the content of the humectant may be, for example, about 0.1 to 100 parts by weight, preferably about 0.5 to 50 parts by weight, and more preferably about 2 to 30 parts by weight (for example, about 4 to 20 parts by weight), relative to 100 parts by weight of the substrate.

Moreover, the content of the humectant may be selected from the range of about 1 to 5000 parts by weight relative to 100 parts by weight of the polysaccharide, and may be, for example, about 10 to 1000 parts by weight, preferably about 20 to 500 parts by weight, and more preferably about 100 to 200 parts by weight.

(Acid)

The cigarette filter material may further comprise an acid. That is, the polysaccharide solution may comprise an acid. The use of such an acid ensures to dissolve the polysaccharide in the polar solvent efficiently even when the polysaccharide is non-soluble (or hardly soluble) in the polar solvent. That is, in the case where the polysaccharide is modified by derivatization to possess solubility to the polar solvent (e.g., water), the acid is not always necessary. However, in the case of the polysaccharide which does not dissolve (or sparingly dissolves) in the polar solvent, the polysaccharide (e.g., a chitosan) is preferably used in combination with the acid in order to treat the substrate. More specifically, since a polysaccharide having an amino group (e.g., a chitosan) is a dense and hard material, it cannot efficiently exert adsorption performance. It is therefore considered, in order to enlarge the surface area of the polysaccharide (e.g., the chitosan) adhered to the substrate, to dissolve the chitosan in an appropriate solvent and involve the chitosan in the substrate. However, the polysaccharide (e.g., the chitosan) is not usually soluble in the conventional polar solvent (e.g., water, and the alcohol).

According to the present invention, the combination use of the amino group-containing polysaccharide (e.g., the chitosan) and the acid usually ensures to treat the substrate in the form of a solution dissolving the polysaccharide (e.g., the chitosan) therein. The treatment with such a solution enables to involve the chitosan uniformly at a large surface area in the substrate. Further, such a treatment can improve the removal efficiency for formaldehyde or the like even at a low content of the chitosan. Moreover, the polysaccharide can be plasticized by involving (or leaving) the acid (and the polar solvent)

within the cigarette filter material. In addition, the action of the hydrogen bond derived from the polysaccharide (e.g., the chitosan) can be inhibited or eased by the effect of the polar solvent. Accordingly, the amino group in the polysaccharide (e.g., the chitosan) plays a great part in removal of the aldehyde (in particular, formaldehyde). As a result, the removal performance on formaldehyde or the like of the polysaccharide can be improved.

The acid used in the present invention is not particularly limited to a specific one as far as the component solubilizes the polysaccharide (e.g., the chitosan) in the polar solvent. Such a polysaccharide can selectively remove an aldehyde component. The acid may include an acid group-containing component, for example, an inorganic acid (e.g., a hydrochloric acid, a sulfuric acid, and a phosphoric acid), an organic acid [for example, an aliphatic carboxylic acid (e.g., an alkanecarboxylic acid such as acetic acid), an aromatic carboxylic acid (e.g., benzoic acid), and a hydroxy acid]. These acids may be used singly or in combination. Incidentally, as the acid, an odorless or slightly odorous component may be preferably used.

The hydroxy acid may be an aromatic hydroxy acid (for example, salicylic acid, and mandelic acid), and may be usually an aliphatic hydroxy acid. Such an aliphatic hydroxy acid may include, for example, an aliphatic hydroxymonocarboxylic acid [e.g., a mono- or dihydroxymonocarboxylic acid (e.g., a mono- or dihydroxy$C_{2-10}$alkanemonocarboxylic acid such as glycolic acid, lactic acid, hydroacrylic acid, α-oxybutyric acid or glyceric acid, preferably a mono- or dihydroxy$C_{2-8}$alkanemonocarboxylic acid, and more preferably a monohydroxy$C_{2-6}$alkanemonocarboxylic acid), and an aliphatic hydroxypolycarboxylic acid (e.g., a mono- or dihydroxy$C_{3-10}$alkanedicarboxylic acid such as tartronic acid, tartaric acid, malic acid or citric acid, and preferably a mono- or dihydroxy$C_{4-8}$alkanedicarboxylic acid)]. These hydroxy acids may be used singly or in combination.

Among these hydroxy acids, in the light of safety for human health, selectively reducing performance on an aldehyde (in particular, formaldehyde), a mono- or dihydroxymonocarboxylic acid is preferred, and particularly a monohydroxy$C_{2-6}$alkanemonocarboxylic acid (in particular, lactic acid) is preferred.

Incidentally, the hydroxy acid having an asymmetric carbon atom (for example, lactic acid) may be a racemic body or an optically-active substance.

Among these acids, the phosphoric acid, the hydroxy acid, and the like have ability or effect to reduce the molecular weight of the polysaccharide (e.g., the chitosan). That is, the polysaccharide (such as the chitosan) usually has a high degree of polymerization and has a high molecular weight. A solution of such a polysaccharide has too high viscosity and is not compatible with easy handling. It is therefore difficult to produce a high concentration solution of the polysaccharide. For that reason, in industrial use of such a polysaccharide, the impregnating amount employed in the present invention falls off. For example, when a chitosan having a conventional high degree of polymerization is dissolved in a dilute acid, even if the concentration of the solution is 1% by weight, such a solution has hardly a low viscosity and is extremely high viscosity.

As the typical methods for reducing the molecular weight of the polysaccharide (e.g., the chitosan), a method of decomposing the polysaccharide with an enzyme, a method of reducing the molecular weight by use of sulfuric acid, and others have been known. Since a low molecular weight chitosan obtained by such a method has a wide distribution in polymerization degree, the utility value of the chitosan declines as well as the yield obtained by such a method is low. On the contrary, in the case of using the phosphoric acid or the like, a low molecular weight chitosan having a narrow distribution in molecular weight can be obtained. These methods are described in, for example, Japanese Patent Application Laid-Open No. 220202/1991 (JP-3-220202A) or others.

In such a light, the preferred acid may include the phosphoric acid, the hydroxy acid, in particular, the hydroxy acid (particularly, a monohydroxy$C_{2-6}$alkanemonocarboxylic acid such as lactic acid).

In the cigarette filter material, the content (or the residual amount) of the acid (e.g., the phosphoric acid, and the hydroxy acid) may be, for example, about 1 to 30 parts by weight (for example, about 1 to 25 parts by weight), preferably about 2 to 20 parts by weight, more preferably about 2 to 15 parts by weight (for example, about 2 to 10 parts by weight), and particularly about 3 to 5 parts by weight relative to 100 parts by weight of the substrate, depending on the concentration or species of the above-mentioned solution of the polysaccharide having an amino group.

Moreover, in the cigarette filter material, the content (or the residual amount) of the acid (e.g., the phosphoric acid, and the hydroxy acid) may be, for example, about 0.001 to 1 mol, preferably about 0.005 to 0.5 mol, more preferably about 0.01 to 0.3 mol (e.g., about 0.02 to 0.2 mol), and particularly about 0.03 to 0.15 mol, relative to 100 mg of the substrate.

Further, in the cigarette filter material, the proportion of the acid may be, in terms of acid group (for example, carboxyl group in the hydroxy acid) (or in the total amount of the acid group in the acid), about 0.1 to 3 mol, preferably about 0.3 to 2.5 mol, more preferably about 0.5 to 2 mol (for example, about 0.7 to 1.5 mol) relative to 1 mol of a glycose unit of the polysaccharide having an amino group.

Incidentally, it is not preferred to use the acid over an amount necessary for enough dissolving the polysaccharide. Moreover, the use of a relatively low molecular weight polysaccharide ensures to increase the concentration of the polysaccharide without increasing the acid concentration.

Incidentally, in the cigarette filter material of the present invention, the amount of the polysaccharide having an amino group, the polar solvent, the humectant or the acid may be adjusted depending on the length of the material or filter. For example, in the case of a short filter, since the delivery of nicotine and tar becomes higher, the amount of the polysaccharide may be increased. Moreover based on this, the amount of the polar solvent or the humectant may be increased.

Incidentally, the cigarette filter material may further contain other component(s), for example, a plasticizer (e.g., triacetin), an inorganic fine powder (e.g., kaolin, talc, diatomaceous earth, quartz, calcium carbonate, barium sulfate, titanium oxide, and alumina), a heat stabilizer (e.g., a salt of an alkali or alkaline earth metal), a coloring agent, a whitening agent, an oil, a retention aid for paper, a sizing agent, an adsorbent (e.g., an activated carbon), a biodegradation or photodecomposition accelerator (e.g., an anatase-type titanium oxide), and a natural polymer or a derivative thereof (e.g., a cellulose powder). These other components may be used singly or in combination.

The form of the cigarette filter material of the present invention is not particularly limited to a specific one, and may be, for example, any of a fibrous form, a capillaceous form, a woven fabric form, a nonwoven fabric form, a tow-like form, a sheet form and a particle form (or a particulate), depending on the form of the substrate. Moreover, the form of the cigarette filter material may be a filter rod form. Incidentally, the substrate (that is, a substrate before being treated with the solution of the polysaccharide having an amino group) may have such a form in advance, or such a form may be given by molding or shaping a coating-treated substrate (for example, a fibrous substrate, and a particulate substrate) by a conventional method (for example, a paper-making method). In particular, the cigarette filter material is preferably a filter rod form (particularly a fiber bundle having a rod structure), as mentioned above.

[Production Process of Cigarette Filter Material]

The cigarette filter material of the present invention may be obtained by coating-treating a substrate with at least a polysaccharide having an amino group and a polar solvent, and may be usually produced by coating a substrate with a solution containing a polysaccharide having an amino group and a polar solvent, if necessary an acid (a polar solvent solution, a solution of a polysaccharide having an amino group). That is, the cigarette filter material of the present invention may be usually obtained by coating a substrate with a solution of a polysaccharide having an amino group to give a material containing at least the polysaccharide having an amino group and a polar solvent (and if necessary a humectant, an acid) in the substrate.

(Solution of Polysaccharide Having an Amino Group)

In the solution of the polysaccharide having an amino group, as the components such as the polysaccharide having an amino group, the polar solvent, the humectant, and the acid (e.g., the hydroxy acid), components as described in the paragraph of the cigarette filter material may be utilized.

The polysaccharide having an amino group usually has a high molecular weight. In the case where the polysaccharide is dissolved in an acidic aqueous solution, the viscosity of the aqueous solution is over 1000 mPa·s even at a concentration of 1% by weight. A liquid having such a viscosity is handful for forming a coating on the substrate by means of a manner such as spraying, coating or dipping. Moreover, in the case where the solid concentration of the polysaccharide is decreased, the coating amount thereof is sometimes insufficient.

In the solution of the polysaccharide, therefore, the polysaccharide is preferably a polysaccharide having a reduced molecular weight as mentioned above (for example, a polysaccharide having a solution viscosity of not higher than 20 mPa·s at 25° C. when the polysaccharide is in an aqueous solution having a concentration of 1% by weight). Such a polysaccharide may be obtained by reducing the molecular weight beforehand by a method described in the above-mentioned document, or by inducing low molecular weight of the polysaccharide in combination with the acid (e.g., the hydroxy acid).

The solution of the polysaccharide contains a polar solvent as an essential component. Such a polar solvent component can simplify the treatment of solution having the polysaccharide to the substrate, and can efficiently adjust the content of the polysaccharide (and that of the hydroxy acid). Moreover, through the coating condition of the solution of the polysaccharide, the polar solvent resides in the cigarette filter material, and ensures to further improve the capability to selectively reduce (or remove) an aldehyde in cooperation with the polysaccharide (and the hydroxy acid) as mentioned above.

In the solution of the polysaccharide, the proportion of the polysaccharide relative to 100 parts by weight of the polar solvent (or the total amount of the polar solvent and the humectant) may be selected from the range of about 0.0005 to 150 parts by weight, and may be for example, about 0.001 to 100 parts by weight (e.g., about 0.005 to 80 parts by weight), preferably about 0.01 to 50 parts by weight (e.g., about 0.05 to 30 parts by weight), more preferably about 0.1 to 20 parts by weight, and particularly about 0.5 to 15 parts by weight (e.g., about 1 to 10 parts by weight).

In particular, in the case of using a chitosan as the polysaccharide, and water and other polar solvent (e.g., glycerin) as a polar solvent, the proportion of the chitosan may be about 0.0005 to 75 parts by weight, preferably about 0.001 to 50 parts by weight, more preferably about 0.005 to 30 parts by weight (for example, about 0.01 to 20 parts by weight), and particularly about 0.05 to 15 parts by weight, relative to 100 parts by weight of the polar solvent (the total amount of the polar solvent). Incidentally, the proportion may be suitably adjusted in accordance with the molecular weight of the polar solvent, the formula weight thereof, the number of the hydroxyl group thereof, and other factors.

Incidentally, the solution of the polysaccharide may further contain the above-mentioned humectant, and the above-mentioned other components (e.g., the plasticizer). The proportion of the humectant may be, for example, about 0.001 to 50 parts by weight, preferably about 0.01 to 30 parts by weight, and more preferably about 0.1 to 10 parts by weight, relative to 100 parts by weight of the polysaccharide.

Moreover, the solution of the polysaccharide may contain an acid as mentioned above. In the case of using the acid, the proportion of the polysaccharide relative to the acid (e.g., the hydroxy acid) in the solution of the polysaccharide [the former/the latter] (weight ratio) may be, for example, about 99/1 to 30/70, preferably about 90/10 to 40/60, and more preferably about 70/30 to 50/50. Incidentally, the amount of the acid is preferably small within the range at which the acid can solve the polysaccharide having an amino group.

Incidentally, the solvent component to the solution of the polysaccharide may comprise at least the polar solvent, and may contain a nonpolar solvent (e.g., the hydrocarbon) as far as the solvent component does not exert an influence on a property for selective reduction (or removal) of formaldehyde.

Moreover, the concentration of the solid content in the solution of the polysaccharide may be, for example, about 0.5 to 50% by weight, preferably about 1 to 30% by weight, and more preferably about 1.5 to 26% by weight (e.g., 2 to 15% by weight).

The viscosity (solution viscosity) of the solution of the polysaccharide may be suitably selected depending on the coating weight of a component such as the polysaccharide, the polar solvent, and the hydroxy acid relative to the substrate; workability; and the like. The viscosity may be, for example, selected from the range of 1 to 20000 mPa·s at 25° C. and 60 rpm measured by a B-type viscosity meter, and may be, for example, about 2 to 10000 mPa·s, preferably about 10 to 5000 mPa·s, more preferably about 30 to 2000 mPa·s (e.g., about 100 to 1200 mPa·s).

(Coating Method)

The coating method (treating method) may be appropriately selected depending on the shape of the substrate (e.g., a fibrous form, and a filter rod form), the material thereof, and is not particularly limited to a specific one as far as the substrate and the solution of the polysaccharide can be contacted with each other. For example, such a method may include (i) a method of dipping (or impregnating or immersing) the substrate in the solution of the polysaccharide, (ii) a method of spraying or sparging (or spreading) the substrate with the solution of the polysaccharide, (iii) a method of coating the substrate with the solution of the polysaccharide, and others. These treatment methods may be used singly or in combination.

Such a coating method of the present invention is easy to introduce the existing manufacturing apparatus for cigarette filter, in particular an apparatus for producing a cigarette filter having a filter rod made from a cellulose acetate filament. Compared with a method of using a particulate polysaccharide having an amino group, or using a dispersion of a polysaccharide having an amino group, the method of the present invention prevents falling off of the polysaccharide from a cigarette filter material or a cigarette filter. Therefore, a cigarette obtained from the present invention has a preferred property or performance. For example, the substrate may be subjected to the solution of the polysaccharide during the step spinning a filter tow in the above method (e.g., coating, and dipping) to form a coat. Further, the coating treatment may be carried out through a manner (such as spraying, coating, or dipping) in a step for forming a filter rod (a rolling up step) by winding off a tow band from a bale of filter tow band to form a coating on the substrate. Moreover, the coating may be formed on the substrate by dipping thus manufactured plug (tow bundle (or rod)) in the polysaccharide solution.

Furthermore, in the coating method, a uniform or homogeneous thin coat may be formed on the surface of the filament. The specific surface area of the polysaccharide can be therefore enlarged. Even when the content of the polysaccharide in the cigarette filter material is low, the performance for reducing formaldehyde can be effective. In addition, compared with the addition of the polysaccharide in the form of a particulate, such an effect can be ensured at the addition of the low amount of the polysaccharide. Accordingly, the performance for selectively reducing formaldehyde may be efficiently improved while inhibiting the physical adsorption effect of the polysaccharide. More specifically, the large amount of the polysaccharide (e.g., the chitosan) generates the physical adsorption similar to the activated carbon, and in this case, the polysaccharide removes fine particulate particles, tar and nicotine. However, by coating (impregnating) the substrate (e.g., the filter tow) with an efficiently plasticized chitosan in the form of a uniform coat, the polysaccharide efficiently brings out the chemical adsorption performance and selectively reduces the formaldehyde while keeping the low reducing rate of fine particles, tar and nicotine. That is, the treatment method of the present invention ensures to further improve the performance for selective reduction of formaldehyde due to a synergistic effect of alleviation of the influence of the hydrogen bond with uniformity of the thin coat.

Among these methods, the method (ii) of spraying or sparging the substrate with the solution of the polysaccharide having an amino group is preferred. In such a method, particularly, in the case where the substrate is a fibrous material (for example, a substrate having a filter rod structure), the polysaccharide and the polar solvent (and the hydroxy acid, and further other component such as the humectant) can be conveniently and efficiently contained in the substrate (or in a dipping part of the substrate).

The coating with the solution of the polysaccharide may be conducted against a part or all of the substrate. In particular, a substrate having a filter rod shape ensures impregnation of the polysaccharide to the bloomed filter rod by setting an apparatus adding a common plasticizer (e.g., triacetin) and an activated carbon for filter rod in the filter rod maker. In this case, it is not necessary to wholly coat the rod with the solution of said polysaccharide. Moreover, in the dipping method (i), at least the whole surface of the substrate (or the dipping part of the substrate) (preferably the whole surface and inside of the dipping part of the substrate) may be treated with the solution of the polysaccharide.

In the dipping method (i), the dipping time (or treatment time) may be selected depending on the embodiment of the polysaccharide or the content thereof, and may be, for example, not shorter than several seconds (for example, 1 second to 24 hours), preferably about 30 seconds to 1 hour, and more preferably about 1 to 30 minutes. Industrially, the dipping time may be, for example, not shorter than several seconds (for example, about not shorter than 1 to 3 seconds), preferably about 1 to 30 seconds, and more preferably about 3 to 15 seconds.

Incidentally, the substrate treated with the solution of the polysaccharide is usually dried. By such drying, volatile components (such as a solvent component) can be removed at some level, and the content of the hydroxy acid or the solvent component (e.g., water) relative to the cigarette filter material can be adjusted.

The drying may be conducted in any manner as far as the necessary residual amount of the polar solvent can be obtained. The drying manner may be sun drying or air drying, and may be usually carried out by a dryer (e.g., a dryer which can reduce pressure (such as a vacuum dryer), and a hot air dryer).

The drying may be carried out under a room temperature (for example, about 15 to 25° C.), or under a warming temperature (for example, about 40 to 200° C., preferably about 45 to 180° C., and more preferably about 50 to 150° C.). Moreover, the drying may be conducted under an atmospheric pressure or a reduced pressure. The drying time may be, depending on the drying conditions or the species of the polar solvent, selected from the range that can hold the polar solvent in the cigarette filter material. For example, the drying time may be not shorter than 1 minute (e.g., about 3 minutes to 10 hours), preferably about 5 minutes to 5 hours (e.g., 10 minutes to 3 hours), more preferably about 20 minutes to 2 hours (e.g., about 30 to 90 minutes). Incidentally, the drying conditions (e.g., the temperature, the drying pressure, and the drying time) may be suitably selected in accordance with the species of the polar solvent. For example, since the polar solvent having a high boiling point (e.g., glycerin) is not volatile (or is slightly volatile), and the solvent can efficiently remain in the cigarette filter material even in the case of being dried under heating and/or for a long period [for example, not shorter than 3 hours (e.g., 5 to 24 hours)].

[Cigarette Filter and Cigarette]

The cigarette filter material of the present invention is useful for constituting a cigarette filter. In the cigarette filter, the cigarette filter material of the present invention may be used singly or in combination depending on the shape thereof. The cigarette filter may comprise the cigarette filter material of the present invention and other cigarette filter material [for example, a graniferous cigarette filter material coating-treated and the fibrous material (e.g., a fibrous material which is not coating-treated)]. For example, the cigarette filter of the present invention may constitute at least one part of a cigarette filter divided into a plurality of parts (e.g., a dual, or a triple), for example, one part of the dual, or both end parts of the triple. Other cigarette filter material may constitute the remaining parts (for example, the other part of the dual, or the intermediate part of the triple). Examples of other cigarette filter material may include a filter material composed of a part having a dalmatian containing a particulate substance (such as an activated carbon) and the other part having a natural.

The cigarette filter may be formed by a conventional method depending on the structure of the substrate or the filter. For example, the filter having a filter rod may be bloomed, then the bloomed filter tow may be applied with a conventional plasticizer (such as triacetin), and then the filter rod may be compacted at a given diameter and wrapped by paper using a filter rod maker. Moreover, the filter not having a filter rod may be produced by a conventional method, for example, (a) a method of filling a fibrous, powdery or other filter material directly in a metal mold for forming filter rod to give a filter plug, (b) a method of filling the filter material in a space of a pre-formed filter plug, and other methods.

The cigarette filter of the present invention comprising the cigarette filter material can efficiently reduce (or remove) an aldehyde (e.g., formaldehyde) while maintaining a palatable component (such as nicotine or tar or both) at a high level. Therefore, the present invention also includes a method for reducing an amount of an aldehyde (particularly, formaldehyde) in main stream smoke, wherein the method comprises forming the filter from the cigarette filter material [more specifically, a method for reducing the amount of the aldehyde (particularly, formaldehyde) while maintaining the amounts of nicotine and tar in main stream smoke].

For example, the retention or retention rate of formaldehyde (or formaldehyde retention) of the cigarette filter (in terms of weight) may be selected from the range of not more than 90% (e.g., about 0 to 88%), and may be for example, not more than 85% (e.g., about 3 to 80%), preferably not more than 70% (e.g., about 5 to 65%), more preferably not more than 65% (e.g., about 10 to 60%), and particularly not more than 50% (e.g., about 15 to 45%). Such a cigarette filter can reduce formaldehyde at a high level.

Moreover, the nicotine retention (in terms of weight) of the cigarette filter and the tar retention (in terms of weight) thereof are not less than 60% (e.g., about 65 to 100%), preferably not less than 70% (e.g., about 75 to 99%) and more preferably not less than 80% (e.g., about 85 to 98%).

In particular, the nicotine retention (in terms of weight) of the cigarette filter may be selected from the range of not less than 60% (e.g., about 65 to 100%), and may be, for example, not less than 70% (e.g., about 75 to 99%), preferably not less than 80% (e.g., about 82 to 98%), and more preferably not less than 85% (e.g., about 88 to 95%). Moreover, the tar retention (in terms of weight) of the cigarette filter may be selected from the range of not less than 65% (e.g., about 70 to 100%), and may be, for example, not less than 75% (e.g., about 78 to 99.9%), preferably not less than 85% (e.g., about 88 to 99.5%), and more preferably not less than 90% (e.g., about 92 to 99%).

Incidentally, the retention (formaldehyde retention, nicotine retention, tar retention) may be measured as the basis for the amount of component (formaldehyde, nicotine, or tar) in smoke passing through a cigarette filter comprising a cigarette filter material before coating treatment. That is, the "retention" is expressed by the following formula when "X" represents an amount of formaldehyde (or nicotine or tar) in smoke passing through a cigarette filter comprising the untreated cigarette filter material (or the cigarette filter material before coating treatment) under given conditions (e.g., flow volume, time period, and number of times) and "Y" represents an amount of formaldehyde (or nicotine or tar) in smoke passing through a cigarette filter comprising the coating-treated cigarette filter material in the same conditions as the case of the measurement of the amount $$\text{Retention}(\%)=(Y/X)\times 100$$

Moreover, in the present invention, since the substrate treated with the solution containing the polysaccharide and the polar solvent is usually employed, the substrate can be incorporated into the cigarette filter without increase of the pressure drop of the cigarette filter. The cigarette filter of the present invention therefore has draw resistance suitable to smoke. The pressure drop of the cigarette filter may be selected from the range of 150 to 600 mmWG (water gage) on the basis that air is passed at a flow volume of 17.5 ml/sec. through a cigarette filter having a length of 120 mm and a circumference of 24.5±0.2 mm, and may be, for example, about 180 to 500 mmWG, preferably about 200 to 450 mmWG (e.g., about 220 to 400 mmWG), and more preferably about 250 to 350 mmWG.

Moreover, the cigarette of the present invention comprises the cigarette filter (or the cigarette filter material). The site to be disposed of the cigarette filter material is not particularly limited to a specific one. In a cigarette shaped in the form of a rod by a wrapper, the cigarette filter is often disposed in the mouthpieth or between the mouthpieth and paper-wrapped cigarette. Incidentally, the periphery of the cross section of the cigarette corresponds to that of the cross section of the filter in many cases, and may be usually about 15 to 30 mm, preferably about 17 to 27 mm.

INDUSTRIAL APPLICABILITY

The cigarette filter material of the present invention is useful for constituting a cigarette filter (and a cigarette). In smoking, such a cigarette filter (and the cigarette) of the present invention can maintain the appropriate pressure drop (draw resistance) while holding a palatable component such as nicotine or tar, and therefore ensures to selectively reduce (or remove) an aldehyde (e.g., formaldehyde), which is a harmful substance on the human body, without deterioration of taste and palatability (aroma and palatability) and of a sense of satisfaction in smoking.

EXAMPLES

The following examples are intended to describe this invention in further detail and should by no means be interpreted as defining the scope of the invention. Incidentally, in the following Examples and Comparative Examples, each properties (a draw resistance, an amount of nicotine, an amount of tar, and an amount of formaldehyde) were measured by using a commercially available cigarette [Peace Light Box (Registered Trademark No. 2122839) manufactured by Japan Tobacco, Inc.] in accordance with the following methods.

[Draw Resistance]

The draw resistance of the above-mentioned cigarette [Peace Light Box (Registered Trademark No. 2122839) manufactured by Japan Tobacco, Inc.)] was directly measured by using a cigarette filter sample containing the leaf part of the cigarette. In the sample, the length of the filter was 25 mm and the periphery thereof was about 25 mm. The draw resistance was determined as a pressure drop measured by using an automatic pressure drop-measuring apparatus (manufactured by Filtrona Instruments & Automation Ltd., FTS300) when the flow volume of air was 17.5 ml/second.

[Amount of Nicotine and Amount of Tar]

The smoking was conduced by using a cigarette filter sample with the use of a piston-type automatic smoking instrument having constant volume (manufactured by Heinr. Borgwaldt GmbH, RM20/CS) at a flow rate of 17.5 ml/second for a smoking period of 2 second/time with a smoking frequency of once per minute. Nicotine and tar in smoke passed through the filter were collected by a glass fiber filter (Cambridge filter), the amount of nicotine was measured by using a gas chromatograph (manufactured by Hitachi, Ltd., G-3000).

The amount of tar was determined based on a gravimetric technique.

The reducing (or removing) rate of nicotine and that of tar were calculated based on the following formula. In the formula, Tn and Tt represent amounts of nicotine and tar, respectively, adhered to a Cambridge filter in control, and Cn and Ct represent amounts of nicotine and tar, respectively, adhered to a Cambridge filter in Comparative Examples and Examples.

$$\text{Reducing rate of nicotine}(\%)=100\times(1-Cn/Tn)$$

$$\text{Reducing rate of tar}(\%)=100\times(1-Ct/Tt)$$

[Reducing Rate of Formaldehyde]

The smoking was conduced by using a cigarette filter sample with the use of a piston-type automatic smoking instrument having constant volume (manufactured by Heinr. Borgwaldt GmbH, RM20/CS) at a flow rate of 17.5 ml/second for a smoking period of 2 second/time with a smoking frequency of once per minute. Formaldehyde in smoke passed through the filter was collected in a DNPH (dinitrophenylhydrazine) solution to derivatize the formaldehyde with DNPH. The ultraviolet ray (UV) absorbance of the derivatized formaldehyde was measured by using a gas chromatograph (manufactured by Hitachi, Ltd., G-3000).

The reducing (or removing) rate of formaldehyde was calculated in accordance with the following formula. In the formula, Tf represents an amount of formaldehyde collected in the control sample, and Cf represents an amount of formaldehyde collected in each sample of Comparative Examples and Examples mentioned below.

$$\text{Reducing rate of formaldehyde}(\%)=100\times(1-Cf/Tf)$$

Comparative Example 1

In Comparative Example 1, a chitosan particle was used. The chitosan particle was prepared by pulverizing "Daichitosan M" (manufactured by Dainichiseika Color & Chemicals Mfg. Co., Ltd.) by means of a pulverizer. The chitosan particle was passed through a sieve to collect a particle passing through a 28 mesh sieve and not passing through a 60 mesh sieve.

In a filter body (25 mm) of a cellulose diacetate crimped fiber tow of a commercially available cigarette [Peace Light Box (Registered Trademark No. 2122839) manufactured by Japan Tobacco, Inc.)], a part of the filter body (14 mm from the end) was cut with a razor. To the obtained longer piece (that is, a piece containing a tobacco leaf-filled part), was inserted a glass tube having a length of 20 mm and an internal diameter of 8 mm in order that the remaining filter (11 mm) was promptly covered with the glass tube. Then, the cigarette and glass tube were united by a sealing tape.

The chitosan powder (20 mg) was filled in the empty space (9 mm) of the glass tube. Then, the cut shorter piece (that is, the filter part (110 mg) having a length of 14 mm) was used to plug the glass tube. Thereafter, the connect part of the glass tube to the filter was also sealed up by wrapping a sealing tape around the connect part. Accordingly, the length of the filter comprising the cellulose diacetate crimped fiber tow was 25 mm. Moreover, the chitosan particle was filled in the extended part (9 mm) between the filters. The filling amount of the chitosan particle was 20 mg per cigarette.

Concerning this cigarette filter sample, the draw resistance, the amount of nicotine, the amount of tar, and the amount of formaldehyde were measured. Then, the reducing rate of nicotine, that of tar and that of formaldehyde were calculated. These results are shown in Table 1.

Incidentally, for evaluating the reducing rate of nicotine, that of tar and that of formaldehyde, a control sample was made in the same manner as the above-mentioned method except that the chitosan particle was not filled.

Comparative Example 2

In Comparative Example 2, an activated carbon commonly used for a cigarette filter was employed. As the activated carbon, a crushed carbon "CW350SZ" was used manufactured by Futamura Chemical Co., Ltd. The crushed carbon was passed through a sieve to collect a particle passing through a 30 mesh sieve and not passing through a 50 mesh sieve. In the same manner as Comparative Example 1, the activated carbon was filled in the extended part between the filters. The filling amount of the activated carbon was 20 mg per cigarette.

Concerning this cigarette filter sample, the draw resistance, the amount of nicotine, the amount of tar, and the amount of formaldehyde were measured. Then, the reducing rate of nicotine, that of tar and that of formaldehyde were calculated. These results are shown in Table 1.

Incidentally, for evaluating the reducing rate of nicotine, that of tar and that of formaldehyde, a control sample was made in the same manner as the above-mentioned method except that the activated carbon was not filled.

Example 1

In the same manner as Comparative Example 1, in a filter body (25 mm) of a cellulose diacetate crimped fiber tow, a part of the filter body (14 mm from the end) was cut with a razor. To the obtained longer piece (that is, a piece containing a tobacco leaf-filled part), was inserted a glass tube having a length of 20 mm and an internal diameter of 8 mm in order that the remaining filter (11 mm) was promptly covered with the glass tube. Then, the cigarette and glass tube were united with a sealing tape.

The cut shorter piece (that is, the filter part having a length of 14 mm) was dipped (or immersed) in a chitosan aqueous solution for 10 minutes, where the chitosan aqueous solution was a solution containing 2% by weight of chitosan (having a degree of deacetylation of 85%) and 1% by weight of lactic acid (that is, a solution obtained by diluting "Daichitosan W-10" (manufactured by Dainichiseika Color & Chemicals Mfg. Co., Ltd.) to five-fold in volume with water). After dipping, the filter part was put in a vacuum dryer, and dried for 60 minutes at a temperature of 18° C. and under a pressure of 680 mmHg. The resulting filter part contained 8.6 mg of chitosan, 4.3 mg of lactic acid and 123 mg of water.

The dried filter part having a length of 14 mm was used to plug the glass tube so that the empty space (9 mm) of the glass tube remained. Then, the connect part of the glass tube to the dried filter was also sealed up by wrapping a sealing tape around the part. Accordingly, the length of the filter comprising the cellulose diacetate crimped fiber tow was 25 mm.

Concerning this cigarette filter sample, the draw resistance, the amount of nicotine, the amount of tar, and the amount of formaldehyde were measured. The retention of nicotine was 97%, that of tar was 99%, the reducing rate of formaldehyde was 66% (that is, the retention was 34%), and the draw resistance was 166 mmWG.

Incidentally, for evaluating the reducing rate of nicotine, that of tar and that of formaldehyde, a control sample was made in the same manner as the above-mentioned method except that the cut filter piece (14 mm) was not treated.

Example 2

In the same manner as Comparative Example 1, in a filter body (25 mm) of a cellulose diacetate crimped fiber tow, a part of the filter body (14 mm from the end) was cut with a razor. To the obtained longer piece (that is, a piece containing a tobacco leaf-filled part), was inserted a glass tube having a length of 20 mm and an internal diameter of 8 mm in order that the remaining filter (11 mm) was promptly covered with the glass tube. Then, the cigarette and glass tube were united with a sealing tape.

The cut shorter piece (that is, the filter part having a length of 14 mm) was dipped in a solution containing a chitosan aqueous solution and 2% by weight of glycerin as a polar solvent (humectant) for 10 minutes, where the chitosan aqueous solution was a solution containing 2% by weight of chitosan (having a degree of deacetylation of 85%) and 1% by weight of lactic acid (that is, a solution obtained by diluting "Daichitosan W-10" (manufactured by Dainichiseika Color & Chemicals Mfg. Co., Ltd.) to five-fold in volume with water). After dipping, the filter part was put in a vacuum dryer, and dried for 8 hours and 30 minutes at a temperature of 18° C. and under a pressure of 680 mmHg. The resulting filter part contained 8.6 mg of chitosan, 4.3 mg of lactic acid, 3 mg of water and 13 mg of glycerin.

The dried filter part having a length of 14 mm was used to plug the glass tube so that the empty space (9 mm) of the glass tube remained. Then, the connect part of the glass tube to the dried filter was also sealed up by wrapping a sealing tape around the part. Accordingly, the length of the filter comprising the cellulose diacetate crimped fiber tow was 25 mm.

Concerning this cigarette filter sample, the draw resistance, the amount of nicotine, the amount of tar, and the amount of formaldehyde were measured. The retention of nicotine was 98%, that of tar was 99%, the reducing rate of formaldehyde was 40% (that is, the retention was 60%), and the draw resistance was 164 mmWG.

Incidentally, for evaluating the reducing rate of nicotine, that of tar and that of formaldehyde, a control sample was made in the same manner as the above-mentioned method except that the cut filter piece (14 mm) was not treated.

Example 3

In the same manner as Comparative Example 1, in a filter body (25 mm) of a cellulose diacetate crimped fiber tow, a part of the filter body (14 mm from the end) was cut with a razor. To the obtained longer piece (that is, apiece containing a tobacco leaf-filled part), was inserted a glass tube having a length of 20 mm and an internal diameter of 8 mm in order that the remaining filter (11 mm) was promptly covered with the glass tube. Then, the cigarette and glass tube were united with a sealing tape.

The cut shorter piece (that is, the filter part having a length of 14 mm) was dipped in a solution containing a chitosan aqueous solution and 1% by weight of glycerin as a polar solvent (humectant) for 10 minutes, where the chitosan aqueous solution was a solution containing 2% by weight of chitosan (having a degree of deacetylation of 85%) and 1% by weight of lactic acid (that is, a solution obtained by diluting "Daichitosan W-10" (manufactured by Dainichiseika Color & Chemicals Mfg. Co., Ltd.) to five-fold in volume with water). After dipping, the filter part was put in a vacuum dryer, and dried for 8 hours and 30 minutes at a temperature of 18° C. and under a pressure of 680 mmHg. The resulting filter part contained 8.6 mg of chitosan, 4.3 mg of lactic acid, 5 mg of water and 7 mg of glycerin.

The dried filter part having a length of 14 mm was used to plug the glass tube so that the empty space (9 mm) of the glass tube remained. Then, the connect part of the glass tube to the dried filter was also sealed up by wrapping a sealing tape around the part. Accordingly, the length of the filter comprising the cellulose diacetate crimped fiber tow was 25 mm.

Concerning this cigarette filter sample, the draw resistance, the amount of nicotine, the amount of tar, and the amount of formaldehyde were measured. The retention of nicotine was 95%, that of tar was 99%, the reducing rate of formaldehyde was 16% (that is, the retention was 84%), and the draw resistance was 154 mmWG.

Incidentally, for evaluating the reducing rate of nicotine, that of tar and that of formaldehyde, a control sample was made in the same manner as the above-mentioned method except that the cut filter piece (14 mm) was not treated.

Example 4

In the same manner as Comparative Example 1, in a filter body (25 mm) of a cellulose diacetate crimped fiber tow, a part of the filter body (14 mm from the end) was cut with a razor. To the obtained longer piece (that is, apiece containing a tobacco leaf-filled part), was inserted a glass tube having a length of 20 mm and an internal diameter of 8 mm in order that the remaining filter (11 mm) was promptly covered with the glass tube. Then, the cigarette and glass tube were united with a sealing tape.

The cut shorter piece (that is, the filter part having a length of 14 mm) was dipped in a solution containing chitosan aqueous solution and 3% by weight of glycerin as a polar solvent (humectant) for 10 minutes, where the chitosan aqueous solution was a solution containing 2% by weight of chitosan (having a degree of deacetylation of 85%) and 1% by weight of lactic acid (that is, a solution obtained by diluting "Daichitosan W-10" (manufactured by Dainichiseika Color & Chemicals Mfg. Co., Ltd.) to five-fold in volume with water). After dipping, the filter part was put in a vacuum dryer, and dried for 8 hours and 30 minutes at a temperature of 18° C. and under a pressure of 680 mmHg. The resulting filter part contained 9.3 mg of chitosan, 4.7 mg of lactic acid, 6 mg of water and 21 mg of glycerin.

The dried filter part having a length of 14 mm was used to plug the glass tube so that the empty space (9 mm) of the glass tube remained. Then, the connect part of the glass tube to the dried filter was also sealed up by wrapping a sealing tape around the part. Accordingly, the length of the filter comprising the cellulose diacetate crimped fiber tow was 25 mm.

Concerning this cigarette filter sample, the draw resistance, the amount of nicotine, the amount of tar, and the amount of formaldehyde were measured. The retention of nicotine was 89%, that of tar was 100%, the reducing rate of formaldehyde was 55% (that is, the retention was 45%), and the draw resistance was 158 mmWG.

Incidentally, for evaluating the reducing rate of nicotine, that of tar and that of formaldehyde, a control sample was made in the same manner as the above-mentioned method except that the cut filter piece (14 mm) was not treated.

Example 5

In the same manner as Comparative Example 1, in a filter body (25 mm) of a cellulose diacetate crimped fiber tow, a part of the filter body (14 mm from the end) was cut with a razor. To the obtained longer piece (that is, a piece containing a tobacco leaf-filled part), was inserted a glass tube having a length of 20 mm and an internal diameter of 8 mm in order that the remaining filter (11 mm) was promptly covered with the glass tube. Then, the cigarette and glass tube were united with a sealing tape.

The cut shorter piece (that is, a filter part having a length of 14 mm) was dipped in a solution containing chitosan aqueous solution and 4% by weight of glycerin as a polar solvent (humectant) for 10 minutes, where the chitosan aqueous solution was a solution containing 2% by weight of chitosan (having a degree of deacetylation of 85%) and 1% by weight of lactic acid (that is, a solution obtained by diluting "Daichitosan W-10" (manufactured by Dainichiseika Color & Chemicals Mfg. Co., Ltd.) to five-fold in volume with water). After dipping, the filter part was put in a vacuum dryer, and dried for 8 hours and 30 minutes at a temperature of 18° C. and under a pressure of 680 mmHg. The resulting filter part contained 9.3 mg of chitosan, 4.7 mg of lactic acid, 6 mg of water and 28 mg of glycerin.

The dried filter part having a length of 14 mm was used to plug the glass tube so that the empty space (9 mm) of the glass tube remained. Then, the connect part of the glass tube to the dried filter was also sealed up by wrapping a sealing tape around the part. Accordingly, the length of the filter comprising the cellulose diacetate crimped fiber tow was 25 mm.

Concerning this cigarette filter sample, the draw resistance, the amount of nicotine, the amount of tar, and the amount of formaldehyde were measured. The retention of nicotine was 89%, that of tar was 99%, the reducing rate of formaldehyde was 57% (that is, the retention was 43%), and the draw resistance was 162 mmWG.

Incidentally, for evaluating the reducing rate of nicotine, that of tar and that of formaldehyde, a control sample was made in the same manner as the above-mentioned method except that the cut filter piece (14 mm) was not treated.

The results are shown in Table 1.

TABLE 1

Table 1

| | Chitosan (mg) | Polar solvent (mg) | Amount of hydroxyl group of polar solvent to 1 mol of glycose unit of chitosan (mol) | Lactic acid (mg) | Draw resistance (mmWG) | Reducing rate of nicotine (%) | Reducing rate of tar (%) | Reducing rate of formaldehyde (%) |
|---|---|---|---|---|---|---|---|---|
| Control | — | — | — | — | 147 | — | — | — |
| Com. Ex. 1 | 20 | — | — | — | 172 | 18 | 5 | 10 |
| Com. Ex. 2 | — | — | — | — | 163 | 37 | 1 | 24 |
| Ex. 1 | 8.6 | water: 123 | 133.8 | 4.3 | 166 | 3 | 1 | 66 |
| Ex. 2 | 8.6 | water: 3<br>glycerin: 13 | 11.6 | 4.3 | 164 | 2 | 1 | 40 |
| Ex. 3 | 8.6 | water: 5<br>glycerin: 7 | 9.9 | 4.3 | 154 | 5 | 1 | 16 |
| Ex. 4 | 9.3 | water: 6<br>glycerin: 21 | 18.4 | 4.7 | 158 | 11 | 0 | 55 |
| Ex. 5 | 9.3 | water: 6<br>glycerin: 28 | 22.6 | 4.7 | 162 | 11 | 1 | 57 |

The invention claimed is:

1. A cigarette filter material comprising a substrate coated with a coating composition containing a chitosan, a polar solvent and an acid, wherein the polar solvent resides in the cigarette filter material.

2. The cigarette filter material according to claim 1, wherein the material has a filter rod structure.

3. The cigarette filter material according to claim 1, wherein the amount of the chitosan is 2 to 20 parts by weight relative to 100 parts by weight of the substrate.

4. The cigarette filter material according to claim 1, wherein the polar solvent comprises at least one hydroxyl group-containing solvent, and the hydroxyl group-containing solvent is selected from the group consisting of water and an alcohol.

5. The cigarette filter material according to claim 4, wherein the proportion of the hydroxyl group-containing solvent is not less than 8 mol, in terms of hydroxyl group, relative to 1 mol of a glycose unit of the chitosan.

6. The cigarette filter material according to claim 1, wherein the acid comprises at least one acid selected from the group consisting of a phosphoric acid and a hydroxy acid.

7. The cigarette filter material according to claim 6, wherein the proportion of the acid is 0.1 to 3 mol, in terms of acid group, relative to 1 mol of a glycose unit of the chitosan.

8. The cigarette filter material according to claim 6, wherein the material comprises a filament and has a filter rod structure, and the material comprises (i) a chitosan, having a degree of deacetylation of not less than 70%, in a proportion of 3 to 15 parts by weight relative to 100 parts by weight of the substrate, (ii) a hydroxyl group-containing solvent in a proportion of not less than 9 mol, in terms of hydroxyl group, relative to 1 mol of a glycose unit of the chitosan, and (iii) a monohydroxy$C_{2-6}$alkanemonocarboxylic acid in a proportion of 0.5 to 2 mol, in terms of carboxyl group, relative to 1 mol of the glycose unit of the chitosan.

9. A process for producing the cigarette filter material recited in claim 1, which comprises coating a substrate with a solution, wherein the solution at least contains the chitosan, polar solvent and acid.

10. The process according to claim 9, wherein the substrate is coated with the solution containing the chitosan, the polar solvent and an acid, and wherein the chitosan has a solution viscosity of 1 to 10 mPa·s at 20° C. in an acetic acid aqueous solution having an acetic acid concentration of 1% by weight.

11. A cigarette filter which is made of cigarette filter material recited in claim 1.

12. A method for reducing an amount of formaldehyde in main stream smoke, which comprises forming the cigarette filter from the cigarette filter material recited in claim 1, wherein the retention of formaldehyde is not more than 65% while maintaining each retention of nicotine and tar of not less than 80%.

13. A cigarette which comprises the cigarette filter recited in claim 11.

* * * * *